United States Patent [19]

Smith

[11] 4,078,590

[45] Mar. 14, 1978

[54] WHOLE TREE REDUCING APPARATUS

[75] Inventor: Leward N. Smith, Remus, Mich.

[73] Assignee: Morbark Industries, Inc., Winn, Mich.

[21] Appl. No.: 757,695

[22] Filed: Jan. 7, 1977

[51] Int. Cl.[2] ..... B27L 11/02

[52] U.S. Cl. ..... 144/176; 144/242 R; 144/247; 144/246 F; 241/92; 241/101.7; 241/278 R

[58] Field of Search ..... 144/242 R, 247, 246 F, 144/162 R, 176; 241/92, 101.7, 278 R

[56] References Cited

U.S. PATENT DOCUMENTS

| | | | |
|---|---|---|---|
| 2,983,291 | 5/1961 | Dick | 144/242 R |
| 3,661,333 | 5/1972 | Smith | 144/162 R |
| 3,724,518 | 4/1973 | Zehavi et al. | 144/247 |
| 3,955,765 | 5/1976 | Gaitten | 144/242 R |

*Primary Examiner*—Donald R. Schran
*Attorney, Agent, or Firm*—Learman & McCulloch

[57] ABSTRACT

An apparatus for reducing whole trees having attached limbs and branches to chips wherein a power driven disc chipper is mounted on a frame and a tree or brush feeding and conditioning mechanism is driven at a coordinated feeding speed for feeding trees and tree parts into the chipper while folding projecting limbs and branches inwardly toward the trunk. A pair of power driven feed rolls, mounted for rotation about generally horizontal axes above and below a feed path, are supported for both coordinated generally vertical movement relative to the frame and for relative vertical movement, and power actuated means are provided for selectively varying the vertical spacing between the pair of feed rolls. The power actuated means are so arranged that when a squeezing action is applied, as to crush vertically projecting limbs, the upward force exerted by the lower roll exceeds the downward force exerted by the upper roll to reduce the frictional force exerted by any obstructing tree parts on the support platform.

12 Claims, 3 Drawing Figures

WHOLE TREE REDUCING APPARATUS

FIELD OF THE INVENTION

The invention relates to apparatus for harvesting whole trees with attached limbs and branches, as well as parts of trees and branches or brush, and particularly to new and novel improvements in smaller size and more compact tree harvesting machines of this character for processing such forest products into usable wood chips.

BACKGROUND OF THE INVENTION

With the advent of the machine described in my prior U.S. Pat. No. 3,661,333, it became possible to reduce entire trees with attached limbs and branches to chips which were useful in a number of industries including the paper-making industry. Such machinery has typically been used in harvesting operations wherein forest or tree plantations were thinned by removing those trees which were ready for harvesting and leaving other trees which would continue their growth.

Machinery of the character to be described is typically useful, in view of its smaller size, to be towed to various locations in the forest where it can process timber and other products which otherwise would be left to rot on the forest floor and wasted. This machine is particularly suited to processing trees with crooked trunks and limbs and bushy, hard to handle, hardwood trees which are of a very "limby" nature. The chips which are harvested can be burned to provide a valuable "energy" resource and are also useful in industries such as the paper-making industry.

SUMMARY OF THE INVENTION

Tree feeding and conditioning mechanism is positioned adjacent a power driven disc chipper having a rearwardly facing entrance opening and driven at a coordinated tree feeding speed to feed trees with attached limbs and branches into the chipper opening which may comprise simply a spout or merely an opening in the front wall of the chipper housing or casing. A pair of power driven feed rolls are mounted for rotation about generally horizontal axes above and below a feed path and are supported both for coordinated generally vertical movement relative to the frame of the machine, as well as for vertical movement relative to each other. The two rolls are supported at the outer ends of support arms pivotally mounted on the machine frame, the arms being coupled to each other by power actuated means arranged to apply the greater portion of a squeezing force to the lower roll. The lowermost roll, along with the branch supporting frame surfaces, forms a power driven, longitudinally extending conveyor or feed bed. The lowermost roll is supported to project upwardly slightly above these frame surfaces.

The present invention may more readily be described by reference to the accompanying drawings.

IN THE DRAWINGS

Figure 1:
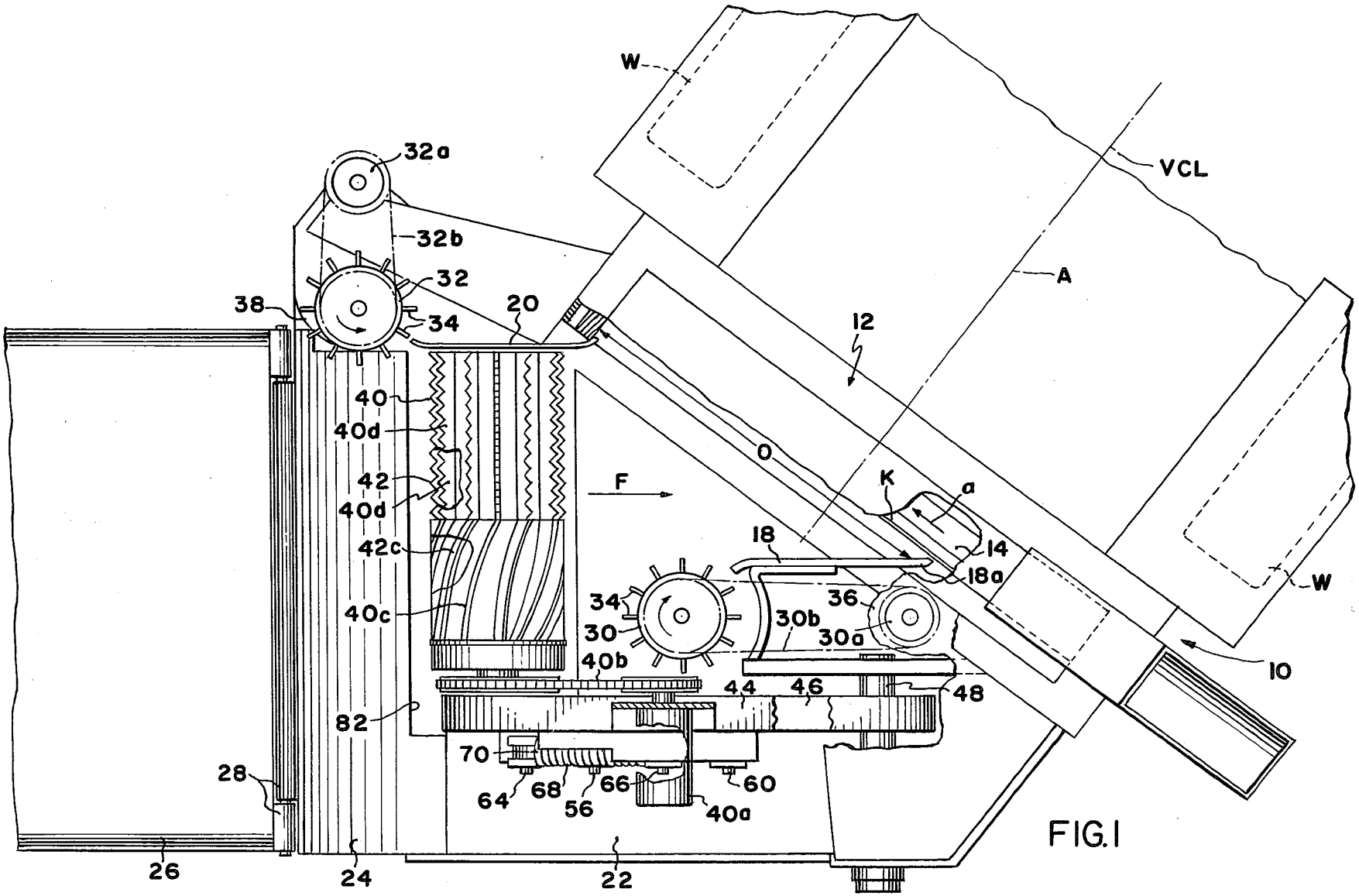
FIG. 1 is a top plan view of a chipping apparatus embodying the present invention with certain parts broken away or shown in section.

A tree chipping apparatus embodying the present invention is constructed as a portable apparatus which includes a fixed frame 10 of more or less conventional design in the general form of a two-wheeled trailer, supported by a pair of ground engaging wheels W (FIG. 1) so that the apparatus may be towed to and from the job site. A disc-type chipper designated generally 12 of well-known construction is fixedly mounted upon the frame 10 with its chipping disc 14 (FIG. 1) mounted for rotation in the direction "*a*" about an axis A parallel to the longitudinal centerline VCL of the vehicle. The chipper disc is driven in rotation by a suitable motor (not shown) mounted upon frame 10 and includes preferably three or four generally radially extending knives mounted on its rear face adjacent slots or openings S through which the chips cut are propelled in the manner indicated in U.S. Pat. Nos. 3,861,602 and 3,000,411 which are incorporated herein by reference. Insofar as the present invention is concerned, the disc-type chipper 12 and its drive motor are well-known to those skilled in the art and conventionally constructed with an entrance opening O (FIG. 1) which encompasses approximately the lower left-hand quadrant of the generally circular rear face 16 of the housing of the chipper which is fixed to frame F.

Referring now particularly to FIG. 1, a pair of vertically extending side guide plates 18 and 20 are fixedly secured to frame 10 and extend rearwardly (to the left as viewed in FIG. 1) from the chipper, the plates at their forward (right-hand) end merging with the opposite sides of the chipper entrance opening O. The side guide plates 18 and 20 define a feed path F which is inclined to the axis of rotation of the chipper disc so that the rotating chipper disc exerts a self-feeding action or draw as the knives are drawn through a log, tree or other piece of material along a path which is inclined forwardly with respect to the direction of feed. The front edge 18*a* of plate 18 projects into the opening O to function as an anvil.

Figures 2, 3:
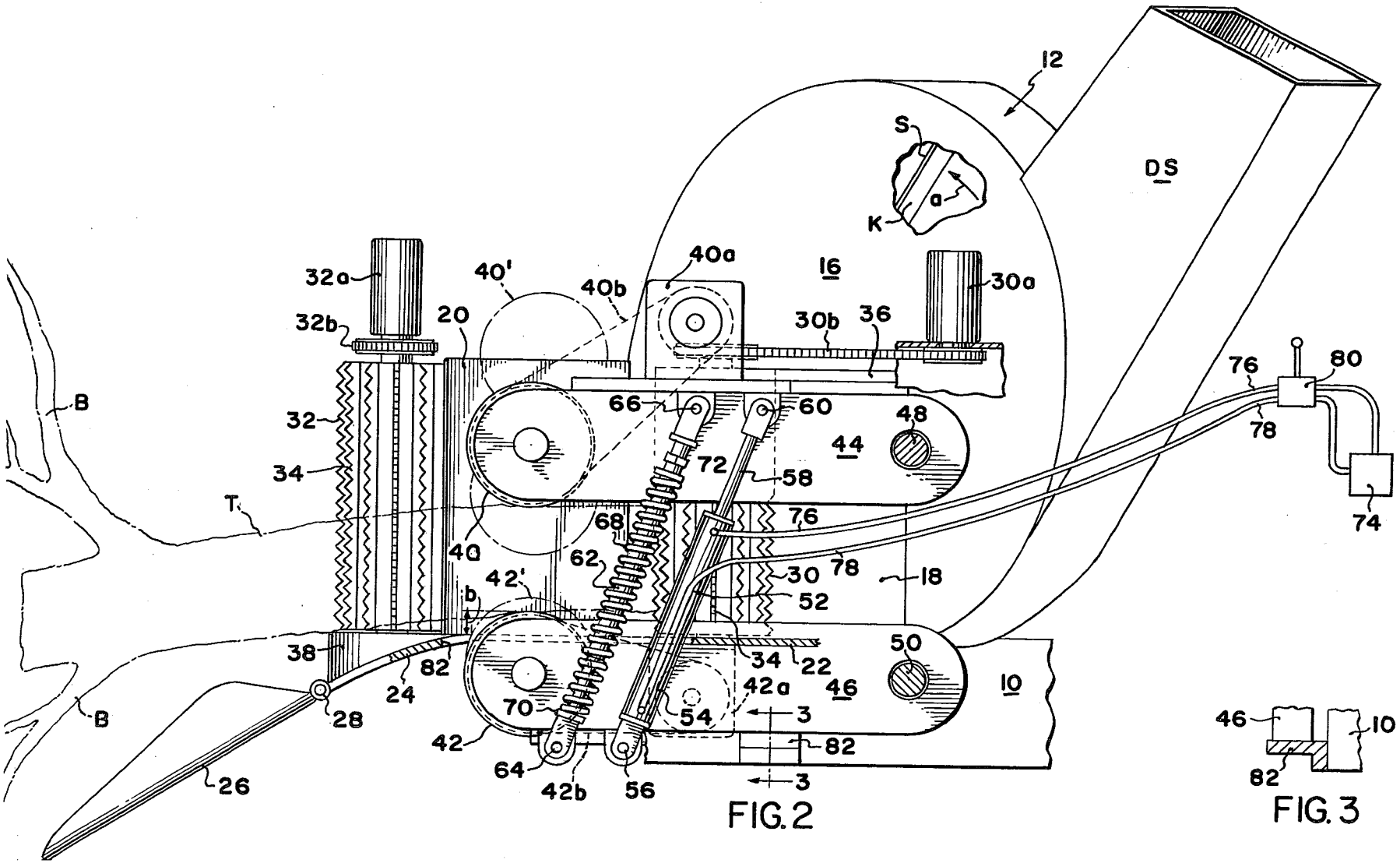
FIG. 2 is a side elevational view of the apparatus of FIG. 1, again, with certain parts broken away or shown in section.
FIG. 3 is a cross-sectional view taken on the line 3—3 of FIG. 2.

Also fixedly mounted on frame 10 is a generally horizontal platform 22 which extends rearwardly from the lower edge of the entrance opening. As best seen in FIG. 2, platform 22 is curved downwardly at its rearward end as at 24 and an apron 26 is hingedly connected to the rearward end of platform 22 as at hinge 28. When the apparatus is set up for operation, apron 26 is in the general position shown in FIG. 2 with its distal or left-hand end as viewed in FIG. 2 resting on the ground to cooperate with the downwardly curved end portion 24 of platform 22 to define an upwardly inclined ramp extending from ground level up to the level of platform 22.

Adjacent the rearward or left-hand ends of guide plates 18 and 20, a pair of power driven side rolls 30 and 32 are mounted for rotation upon frame 10 about fixedly located vertical axes. Rolls 30 and 32, as best seen in FIG. 1, are so located that a rearward extension of the general planes of the side guide plates 18 and 20 would respectively intersect the inner peripheral portion of rolls 30 and 32 or, more accurately, the radially projecting axially extending brush and branch driving vanes or fins 34 which project outwardly from the the periphery of the rolls 30 and 32. Rolls 30 and 32 are normally driven in rotation by respective reversible drive motors 30*a* and 32*a* via chains 30*b* and 32*b* respectively, to rotate in directions indicated by the directional arrows of FIG. 1 so that the inner peripheries of the rolls are driven in a direction toward the entrance opening O of the chipper during normal operation. Motors 30*a* and 32*a* are driven at coordinated speeds such that the linear feed speeds of rolls 30 and 32 are the same.

Roll 30 is located with its lower axial end closely spaced above the upper surface of platform 22 and its upper end is rotatably journaled in a fixed arm 36 (FIG. 2) which is fixedly mounted upon and projects horizontally rearwardly from the chipper housing at the upper edge of the chipper opening O. Side roll 32 likewise is located with its lower end spaced slightly above the level of platform 22 and with its upper end projecting slightly above the top of side guide plate 20 as best seen in FIG. 2. Because side roll 30 is mounted adjacent the rearward or left-hand end of platform 22, a shroud plate 38 is mounted upon the downwardly curved end portion 24 of platform 22 to prevent material being fed from the chipper from working its way under the lower end of side roll 30. As best seen in FIG. 2, the exposed edges of the radially projecting vanes 34 on rolls 30 and 32 are formed with a serrated or saw-toothed edge configuration.

A second pair of power driven feed rolls 40 and 42 are mounted for cantilevered rotation about horizontal axes at the distal ends of support arms 44 and 46 respectively which in turn are pivotally mounted for rotation about horizontal axes upon frame 10 as at 48 and 50. As best seen in FIG. 1, the horizontal axes of rotation of laterally extending rolls 40 and 42 and the pivotal mountings 48 and 50 of their respective support arms are generally perpendicular to the feed path F and transversely inclined with respect to the axis of rotation A of the chipper disc. Upper roll 40 is driven in rotation by a reversible drive motor 40*a* via chain 40*b*, while lower roll 42 is driven in rotation by a reversible drive motor 42*a* mounted beneath platform 22 via chain 42*b*. The rolls 40 and 42 both have helical projecting bars 40*c* and 42*c* and projecting bars 40*d* and 42*d*, the helical bars 40*c* and 42*c* tending to move the tree toward the plate 20 as well as furnishing multiple tree engaging surfaces. Both of rolls 40 and 42 are normally driven so that their inner facing opposed surfaces move at the same feeding speed as those of rolls 30 and 32 in a direction toward the chipper entrance O. Coordination of the feed speeds of the various rolls may be achieved by a control system such as that disclosed in Smith U.S. Pat. No. 3,661,333 (also incorporated herein by reference) with the drive motor for driving the lower drag conveyor in that patent being the motor 42*a* herein.

A fluid pressure actuated motor designated generally 52 is mounted between support arms 44 and 46 with its cylinder 54 pivotally coupled to support arm 46 as at 56 and its piston rod 58 pivotally connected to support arm 44 as at 60. A telescopic cylinder 62 is likewise coupled between support arms 44 and 46 as by pivotal connections 64 and 66 respectively, cylinder 62 being surrounded by a tension spring 68 acting between seating plates 70, 72 at opposite ends of telescopic cylinder 62 to normally bias the upper and lower feed rolls 40 and 42 vertically toward each other. Other positions of rolls 40 and 42 are shown at 40' and 42'. Motor 52 is coupled to a schematically illustrated pressure source and sump 74 by rod and head end conduits 76, 78 respectively which are hydraulically connected to the pressure source-sump 74 via a conventional manually controlled valve 80. Control valve 80 is normally manipulated so that motor 52 is actuated to attempt to extend its piston rod 58 in opposition to the tension spring 68 so that the force urging rollers 40 and 42 toward each other can be varied or overcome by controlling the supply and exhaust of pressure fluid to motor 52. A fixed stop 82 mounted on frame 10 establishes a lower limit of movement of lower support arm 46 at a position such that the upper portion of lower roll 42 projects upwardly a predetermined distance "*b*" above the plane of platform 22 as best seen in FIG. 2. The distance "*b*" is exaggerated in the drawings for purposes of illustration — in practice it is about ½ inch. Platform 22 is formed with an opening 82 providing clearance for roll 40 to move vertically upwardly as indicated in broken line in FIG. 2.

As shown in FIG. 2, motor 52 and tension spring 68 are mounted in a parallel vertically inclined position such that the distances or lever arms from upper support arm pivot 48 to the pivotal connections 60 and 66 of the motor and spring are much shorter than the corresponding lever arms from lower support arm pivot 50 to the pivotal connections 56 and 64. When a tree T is in position between rolls 40 and 42 as shown in FIG. 2, an obstruction projecting from the tree trunk may rest upon platform 22 with roll 40 in turn resting on the tree. In this situation, arm 46 will be raised off stop 82, with which it normally is in engagement. Roll 40 is urged downwardly against the tree by not only its own weight, but also by the weight of its support arm 44, motor 42, and spring 68 plus that of lower roll 42 and its support arm 46, these latter elements being suspended from upper roll support arm 44. with motor 52 in a neutral condition (exerting no force on arms 44 and 46) tension spring 68 acts to draw the upper and lower roll toward each other. The tensile forces exerted at the opposite ends of spring 68 are equal and oppositely directed, however these forces are applied to different lever arms — namely the distance between pivots 48 and 66 on upper arm 44 and the distance between pivots 50 and 64 on lower arm 46. Thus, the spring force urging lower roll 42 upwardly exceeds that urging upper roll 40 downwardly, this force differential in turn reducing the gravity loads otherwise forcing the tree down on platform 22 and lightening the weight of the tree on platform 22 to reduce the frictional resistance between the tree obstruction and platform. Application of pressure to cylinder 54 in a direction augmenting the spring force increases the foregoing effect.

Operation of the apparatus described above is as follows. The apparatus is towed to the desired location and parked. Normally, the apparatus is uncoupled from the towing vehicle and its forward end is supported by one or more stabilizers of conventional construction well-known to those skilled in this art. The apparatus in the usual case is provided with a power operated sliding boom or knuckle boom type loader (not shown) which is employed by the operator to pick up felled trees skidded to a location adjacent the apparatus and to insert the trees butt end first into position between the feed rolls which can then advance the tree butt end first into the entrance opening of the chipper into operative relationship with the chipper knives K.

Referring to FIG. 2, a tree T, having attached limbs and branches B is shown in operative relationship with the apparatus. The tree may be initially supported by the loader (not shown) while being moved toward opening O and is shown with its butt end resting on the lower feed roll 42. The butt end of the tree passes under upper roll 40, which may be driven to an elevated position to receive the butt end of the larger trees by extending the piston rod of motor 52 to separate rolls 40 and 42 as necessary during the initial inserting of the tree. Once the tree butt is inserted between rolls 40 and 42, the power cylinder 54 is released to permit the rolls 40 and 42 to grip the trunk via the biasing force exerted by spring 68. The tree also passes between side rolls 30 and 32 and their respective conjunctive guide plates 18 and 20 which guide the butt of the tree laterally into entrance opening O of the chipper. The ramp and platform 26, 22 provide an underlying support surface for projecting branches. As described above, once the butt end of the tree is moved into contact with the rotating chipper disc, the chipper knives exert a draw or self-feeding action tending to draw the tree into the chipper. Side rolls 30 and 32 and upper and lower rolls 40 and 42 further augment the feeding action in that they are driven in rotation by their respective drive motors in directions such that the tree contacting portions of the roll tend to act to drive the tree toward the chipper. Side rolls 30 and 32, top roll 40 and bottom roll 42 also perform a power folding function concurrently with their feeding operation in that these rolls act to fold projecting branches inwardly toward the trunk of the tree so that the branches are compressed into an envelope corresponding generally to the outer dimensions of the entrance opening of the chipper.

Where large vertically projecting limbs are encountered, the top and bottom rolls 40 and 42 are permitted to separate to allow the rolls to move along the projecting branch as far as possible and motor 52 is then actuated to draw the rolls together to powerfully compress or break the branch. The surface 22 along with the tree contacting surfaces of roll 42 constitute a longitudinally extending conveyor means or feed bed, with folded in and bunched brush and branches contacting multiple bars 42*c* and multiple bars 42*d* simultaneously as the tree moves forwardly. Upper roll 40 may be drawn downwardly toward lower roll 42 as necessary by appropriate actuation of motor 52 to exert a vertical squeeze on the tree.

During the feeding operation, hydraulic motor 52 is actuated as necessary to draw top roll 40 and bottom roll 42 toward each other to exert a vertical squeeze on the tree passing between these two rolls. The pivotal mounting 48 and 50 of support arms 44 and 46 which carry upper and lower rolls 40 and 42 permits the two rolls to float upwardly and downwardly during the feeding operation as may be required by crooked trunks or uneven density of branches on opposite sides of the trunk as the tree passes to the chipper. The stop 82 operates to hold the tree in a slightly raised position, i.e. one-half inch, above support surface 22 so that the advance of the tree is not encumbered by frictional drag generated by forcing the tree trunk down against stationary frame surfaces. Moreover, because surfaces 24 and 26 incline downwardly, a crooked trunked tree can be accommodated with a minimum of frictional contact (drag) surface. The chipper acts on the material fed to its knives in a well-known manner, reducing the tree to chips as the tree is fed to the chipper, the chips being discharged from the interior of the chipper housing through the discharge spout DS in a well-known manner.

When operations at a given site are completed, the trunk unit is reattached to the towing vehicle and apron 26 is hinged upwardly to a generally vertical position and latched in a stored position by a suitable mechanical latch, now shown, for transport.

While one embodiment of the invention has been described, it will be apparent to those skilled in the art that the disclosed embodiment may be modified. Therefore, the foregoing description should be considered exemplary rather than limiting, and the true scope of the invention is that defined in the following claims.

What is claimed is:

1. In an apparatus for reducing whole trees having attached limbs and branches to chips, said apparatus including a frame, a power driven chipper mounted on said frame and having a rearwardly facing entrance opening, and tree feeding and conditioning means mounted on said frame rearwardly of said entrance opening for feeding trees having attached limbs and branches forwardly along a feed path into said entrance opening while folding projecting limbs and branches inwardly toward the trunk of the tree; the improvement wherein said feeding and conditioning means comprises upper and lower support arms each pivotally mounted at one end upon said frame for free pivotal movement about spaced parallel upper and lower horizontal axes, power driven upper and lower feed rolls mounted in vertically opposed relationship to each other at the respective outer ends of said upper and lower arms and rotatable about parallel horizontal axes normal to said feed path, power actuated means for varying the vertical spacing between said upper and lower feed rolls, upper pivot means coupling said power actuated means to said upper arm at a first distance from said upper horizontal axis, and lower pivot means coupling said power actuated means to said lower arm at a second distance, greater than said first distance, from said lower horizontal axis.

2. The invention defined in claim 1 wherein said power actuated means comprises spring means coupled between said upper and lower arms resiliently biasing said arms in a first direction relative to one another, and fluid motor means coupled between said upper and lower arms actuable to exert a selectively variable biasing force on said arms in opposition or addition to the biasing force exerted by said spring means.

3. The invention defined in claim 2 wherein said spring means is a tension spring biasing said arms toward each other, the pivotal connection between said upper arm and spring being spaced from the horizontal upper arm axis by distance less than the spacing between the pivotal connection between said lower arm and said spring and the horizontal lower arm axis.

4. The invention defined in claim 1 further comprising stop means on said frame establishing a lower limit of movement of said lower arm relative to said frame.

5. The invention defined in claim 4 wherein said frame comprises a generally horizontal platform extending rearwardly from the lower edge of said entrance opening, said platform having an opening therethrough accommodating vertical movement of said lower roll, said stop means establishing said lower limit of movement at a location wherein the upper portion of said lower roll projects upwardly through said opening above the upper surface of said platform.

6. In an apparatus for reducing whole trees having attached limbs and branches to chips, said apparatus including a frame, a power driven chipper mounted on said frame having a rearwardly facing entrance opening, and tree feeding and conditioning means mounted on said frame rearwardly of said entrance opening for feeding trees having attached limbs and branches forwardly along a feed path into said entrance opening while folding projecting limbs and branches inwardly toward the trunk of said tree; the improvement wherein said feeding and conditioning means comprises a first pair of power driven feed rolls mounted on opposite sides of said feed path for rotation about generally vertical fixed axes, a second pair of power driven feed rolls mounted for rotation about generally horizontal axes above and below said feed path in generally vertical alignment with each other in rearwardly spaced relationship from said entrance opening, support means supporting said second pair of feed rolls for coordinated generally vertical movement relative to said frame, and power actuated means for selectively varying the vertical spacing between said second pair of feed rolls, one of said first pair of rolls being located at one side of said feed path between said second pair of rolls and said chipper and the other of said first pair of rolls being located on the opposite side of said feed path rearwardly of said second pair of rolls.

7. The invention defined in claim 6 further comprising a pair of stationary side guide plates extending from locations adjacent said first pair of rolls to said entrance opening of said chipper.

8. The invention defined in claim 6 wherein said second pair of rolls extend transversely across said feed path and project outwardly from opposite sides of said feed plates beyond the inner sides of said first pair of rolls.

9. The invention defined in claim 6 wherein said frame is a portable frame having a longitudinal centerline, a pair of ground engaging wheels supporting said frame, said chipper is a disc-type chipper having a knife carrying chipper disc mounted for rotation about an axis parallel to said longitudinal centerline, a pair of side guide plates extending rearwardly from opposite sides of said chipper opening to define said feed path extending along a line inclined to said longitudinal centerline, and a platform extending rearwardly from the lower side of said entrance opening, said first pair of rolls extending upwardly from said platform adjacent the rearward edges of said guide plates with the inner peripheral portions of said first pair of rolls being inboard of the ends of the second pair of rolls.

10. The invention defined in claim 9 wherein the axes of said second pair of rolls extend normal to said feed path, one of said first pair of rolls being located forwardly of said second pair of rolls and the other of said first pair of rolls being located rearwardly of said second pair of rolls.

11. In an apparatus for reducing whole trees having attached limbs and branches to chips, said apparatus including a frame, a power driven chipper mounted on said frame and having a rearwardly facing entrance opening, and tree feeding and conditioning means mounted on said frame rearwardly of said entrance opening for feeding trees having attached limbs and branches forwardly along a feed path into said entrance opening while folding projecting limbs and branches inwardly toward the trunk of the tree, said feeding and conditioning means including power driven upper and lower endlessly driven feed members mounted on said frame in vertically opposed relationship to each other above and below said feed path, mounting means mounting said feed members for movement toward and away from each other to grip and feed trees toward said entrance opening; the improvement comprising power actuated means for biasing said feed members toward or away from each other, and coupling means on said power actuated means for applying the greater portion of the biasing force applied by said power actuated means to the lower of said feed members.

12. In an apparatus for reducing whole trees having attached limbs and branches to chips, said apparatus including a frame, a power driven chipper mounted on said frame and having a rearwardly facing entrance opening, and tree feeding and conditioning means mounted on said frame rearwardly of said entrance opening for feeding trees having attached limbs and branches forwardly along a feed path into said entrance opening while folding projecting limbs and branches inwardly toward the trunk of the tree; the improvement wherein said feeding and conditioning means comprises upper and lower support arms each pivotally mounted at one end upon said frame for free floating pivotal movement relative to said frame about vertically spaced horizontal axes, power driven upper and lower feed rolls rotatably mounted at the respective opposite ends of said arms for feeding trees gripped between said rolls to said entrance opening, means biasing said arms toward each other to cause said rolls to forcibly grip said trees, said floating arms accommodating vertical movement of said rolls as occasioned by vertical shifting of the portion of the tree gripped by said rolls during the feeding operation, and fixed stop means mounted on said frame engageable with said lower arm to define a lower end limit of movement of said lower roll relative to said frame at a location wherein the upper portion of said lower roll is at an elevation slightly above the bottom of said entrance opening.

* * * * *